US005203794A

United States Patent [19]

Stratford et al.

[11] Patent Number: 5,203,794

[45] Date of Patent: Apr. 20, 1993

[54] ICE BLASTING APPARATUS

[75] Inventors: Scott M. Stratford, Alta Loma; Philip Spivak, Toluca Lake; Oleg Zadorozhny, North Hollywood; Alan E. Opel, Monrovia, all of Calif.

[73] Assignee: Alpheus Cleaning Technologies Corp., Rancho Cucamonga, Calif.

[21] Appl. No.: 715,790

[22] Filed: Jun. 14, 1991

[51] Int. Cl.[5] ..... B24C 3/00

[52] U.S. Cl. ..... 51/410; 51/320; 51/322

[58] Field of Search ..... 51/410, 320, 322

[56] References Cited

U.S. PATENT DOCUMENTS

| | | | |
|---|---|---|---|
| 3,670,516 | 6/1972 | Duron et al. | 62/35 |
| 4,033,736 | 7/1977 | Cann | 62/10 |
| 4,038,786 | 8/1977 | Fong | 51/320 |
| 4,325,720 | 4/1982 | Students | 62/35 |
| 4,389,820 | 6/1983 | Fong et al. | 51/410 |
| 4,415,346 | 11/1983 | Love | 62/35 |
| 4,799,831 | 1/1989 | Ariaz | 406/136 |
| 4,947,592 | 8/1990 | Lloyd et al. | 51/322 |
| 4,965,968 | 10/1990 | Kelsall | 51/410 |
| 5,009,240 | 4/1991 | Levi | 51/320 |
| 5,025,597 | 6/1991 | Tada et al. | 51/322 |
| 5,074,083 | 12/1991 | Kanno et al. | 51/410 |

OTHER PUBLICATIONS

Watlow, Inc. catalog; pp. 228 and 229; St. Louis, Mo.; no date.

"All problems are not alike" ad; Koch Engineering Company Inc., Wichita, Kans.; 1 p.; Apr. 1991.

*Primary Examiner*—Frank T. Yost
*Assistant Examiner*—Hwei-Siu Payer
*Attorney, Agent, or Firm*—Sheldon & Mak

[57] ABSTRACT

A system (10) for delivering a cold particulate material (14) has a closed storage hopper (12) for the material, the hopper having a bottom hopper outlet (16); a venturi feeder (22) having a material inlet (20) for feeding the material, a material conduit (26) to a remote nozzle (30), and a gas inlet (24); a hopper passage (18) connecting the hopper outlet to the feeder material inlet; a gas feed valve (33), the gas feed valve being openable in response to a feed signal (40) for activating the feeder and a blast conduit to the nozzle; a heater (50) in the blast conduit for limiting cooling of a workpiece without adversely heating the material; and a comminutor (52) in the material line proximate the nozzle for delivery of the material at reduced particle size to the nozzle for increased blasting effectiveness.

10 Claims, 1 Drawing Sheet

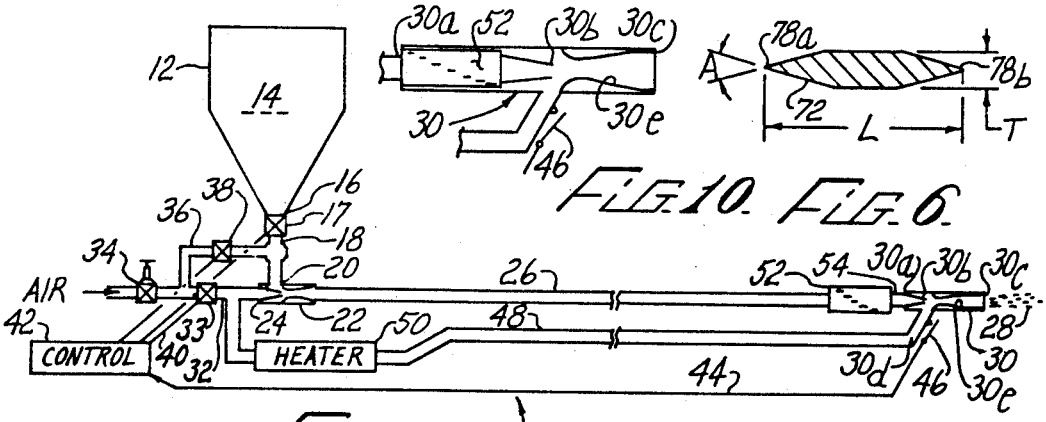
FIG. 1.
FIG. 10.
FIG. 6.
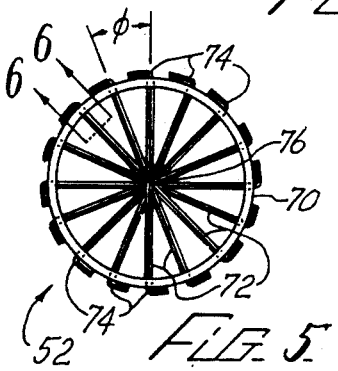
FIG. 5.
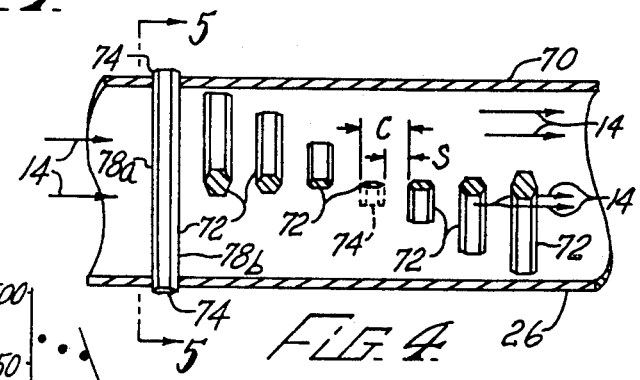
FIG. 4.
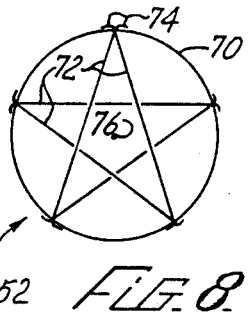
FIG. 8.
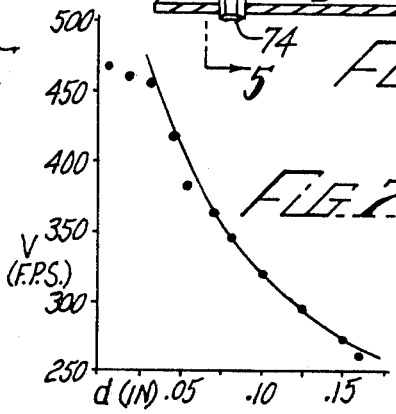
FIG. 7.
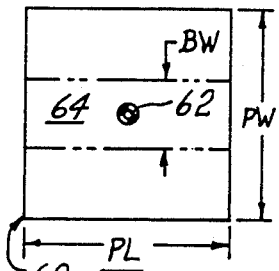
FIG. 2.
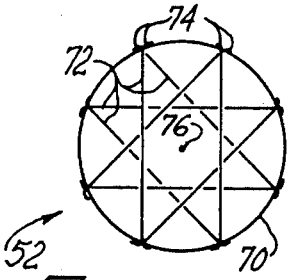
FIG. 9.
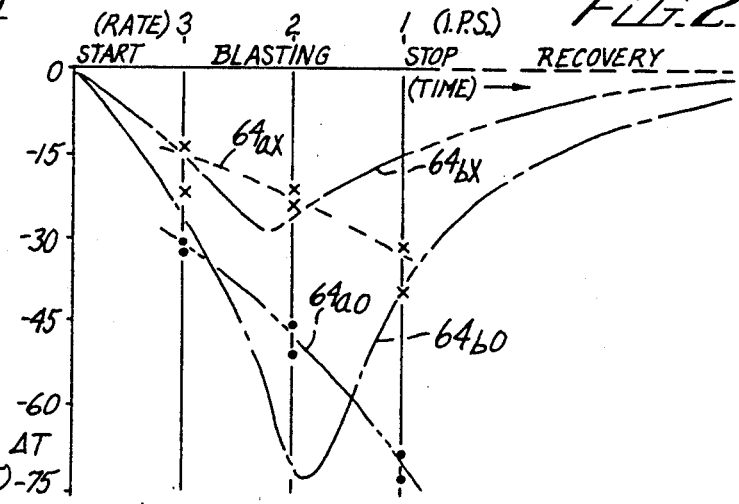
FIG. 3.

ICE BLASTING APPARATUS

BACKGROUND

The present invention relates to systems for transporting and delivering ice particles at high velocity onto a workpiece for cleaning or other treatment of the workpiece.

It is commonly known to blast a workpiece with a particulate abrasive that either melts or sublimes at room temperature for cleanly dissipating the abrasive subsequent to its use, thereby avoiding contamination of the workpiece or its environment. The abrasive can be frozen water, typically called "ice", solid carbon dioxide, typically called "dry ice", or combinations comprising one or both of these materials. One well known process for forming the particulate as dry ice is disclosed in U.S. Pat. No. 4,389,820 to Fong et al, wherein liquid $CO_2$ is dispensed and frozen in a snow chamber, the snow falling into a planetary extruder die mechanism where it is compacted into pellets by being forced through radial holes of a ring-shaped die, the length of the pellets being defined by structure that fractures the material by partially blocking the exit paths from the die. The pellets can be dispensed directly upon formation or they can be stored and/or transported for use upon demand in a hopper or the like. Among the problems in this art are the following:

1. The size of the particles greatly affects blasting quality and efficiency, large particles being desirable for breaking through crusty contamination of the workpiece, smaller particles being needed for reaching small features of the workpiece, and different mixes of sizes are needed for many jobs;

2. It is more difficult to make small pellets than big ones;

3. It is difficult and expensive to adjust the particle size by changing the diameter of the pellets, in that the die is difficult to replace and the multiplicity of radial holes are expensive to produce;

4. Although some adjustment in particle size is possible by changing the length between fractures of the emerging material, the length must be maintained at near twice the diameter for uniform particle size-shortening the distance between the fractures produces greater relative variation in the length of the pellets, and attempts to make the length very short seriously degrades the integrity of the particles while subjecting the die to clogging;

5. The particles are subject to degradation by subliming, by melting, and by abrasion or pulverization during transport to the workpiece, these mechanisms having increasingly adverse effects as the particle size is reduced; and 6. The delivery of particles at very low temperatures rapidly cools the workpiece, often with undesirable effects. For example, when the workpiece is cooled below the dew-point, moisture collects thereon subsequent to the treatment, the moisture tending to attract other contaminants and thereby defeating the purpose of the treatment.

Thus there is a need for a delivery system for hygroscopic or deliquescent particulate that delivers the material at high velocity and low temperature with precise control of particle size distribution. There is a further need for such a blasting system that avoids excessive cooling of the workpiece without degrading the particulate.

SUMMARY

The present invention meets this need by providing an apparatus for treatment of a workpiece by blasting same with sublimable particles. In one aspect of the invention, the apparatus includes a source of the particles; a nozzle unit spaced from the source and having a gas inlet for receiving a high pressure gas, and a particulate inlet for receiving the particles and in fluid communication with a material outlet, a nozzle outlet in fluid communication with the gas inlet being located downstream of the material outlet; transport means for transporting the particles from the source to the particulate inlet of the nozzle unit; divider means proximate the particulate inlet of the nozzle unit for splitting at least a portion of the particles, whereby the average volume of the particles is reduced from an incoming first average volume per particle to a second average volume per particle, the second average volume being less than approximately the first average volume; and accelerator means in the nozzle unit for accelerating the particles to high velocity in response to the high pressure gas.

In another aspect of the invention, the apparatus includes the source of the particles, the nozzle unit, the transport means, the accelerator means, and heater means for heating the high pressure gas, whereby the particles are delivered from the nozzle in a stream of outlet gas, the outlet gas having a gas temperature at the nozzle outlet, the gas temperature being at least 20° C. above the particle temperature for limiting heat removal from the workpiece.

DRAWINGS

These and other features, aspects, and advantages of the present invention will become better understood with reference to the following description, appended claims, and accompanying drawings, where:

FIG. 1 is a pictorial diagram of a particulate delivery system according to the present invention;

FIG. 2 is a plan view of a test workpiece for the system of FIG. 1;

FIG. 3 is a graph showing the temperature drop of the workpiece of FIG. 2 when subjected to blasting by the system of FIG. 1 in alternative modes of operation, and at different rates of progression of the blasting;

FIG. 4 is a lateral sectional view of a portion of the system of FIG. 1;

FIG. 5 is an axial sectional view of the system of FIG. 1 on line 5—5 of FIG. 4;

FIG. 6 is a lateral sectional detail view of the system of FIG. 1 on line 6—6 of FIG. 4;

FIG. 7 is a graph showing test results relating particle size and velocity at constant blasting pressure;

FIG. 8 is a pictorial diagram in the orientation of FIG. 5 showing an alternative configuration of the system of FIG. 1;

FIG. 9 is a pictorial diagram as in FIG. 8, showing another alternative configuration of the system of FIG. 1; and FIG. 10 is a detail pictorial diagram showing an alternative configuration of a nozzle portion of the delivery system of FIG. 1.

DESCRIPTION

The present invention is directed to a system for controlled discharge and delivery of a particulate medium at low temperature and high velocity for treating a workpiece. With reference to FIG. 1 of the drawings, a particulate blasting system 10 includes a hopper 12 for receiving a quantity of a particulate media 14, the hopper 12 having a bottom hopper outlet 16 that is connected through a hopper valve 17 to a closed, downwardly directed hopper passage 18. The passage 18 leads to a material inlet 20 of feeder means 22 for controllably feeding the media 14 from the hopper 12 in response to gas pressure at a gas inlet 24 of the feeder means 22, the media 14 being transported along with the gas through a material conduit 26 for producing a particulate stream 28 from nozzle means 30, the nozzle means 30 accelerating the media 14 as further described below. A main passage 32 connects the gas inlet 24 of the feeder means 22 through a main or feed valve 33 to a suitable source of compressed air or other gas (not shown). A pressure regulator or adjustment valve 34 is interposed between the feed valve 33 and the source of gas for providing a suitable gas pressure at the gas inlet 24 and a corresponding rate of flow of the media 14.

Also shown in FIG. 1, is a bypass passage 36 having a bypass valve 38 for selectively pressurizing the hopper passage 18 as more fully described U.S. Pat. No. 5,071,289 which is assigned to the assignee of this application and incorporated herein by this reference, whereby gas momentarily flows upwardly through the hopper outlet 16 into the hopper 12, and downwardly into the material inlet 20 of the feeder means 22 for avoiding blockages of the media 14. It will be understood that the details of the feeder means 22, and the means for supplying the pelletized media 14 are not critical, being outside the scope of the present invention.

The feed valve 33 is connected for selectively opening the main passage 32 to the gas inlet 24 of the feeder means 22 in response to a transport signal 40 from suitable control means 42, the control means 42 being responsive to a dispenser signal 44 from a dispenser switch 46, the dispenser switch 46 being located for convenient operator control on the nozzle means 30, as described further in the above-referenced copending patent application.

According to one aspect of the present invention, a blast conduit 48 is fluid-connected between the main passage 32 and the nozzle means as further described below, and having heater means 50 series-connected therein for heating gas that flows therethrough to the nozzle means 30, the gas from the blast conduit 48 accelerating to high velocity the particulate media 14 that is delivered to the nozzle means 30 through the material conduit 26. The use of a blast conduit separate from the material conduit 26 for accelerating the media 14 is known in the art and further described in the above-referenced U.S. Pat. No. 4,389,820 to Fong et al. The heater means 50 is particularly effective in highly concentrated blasting of very cold particulate for reduced cooling of the workpiece, without producing excessive heating of the media 14. In an exemplary configuration of the apparatus 10, a 9 kW circulation heater suitable for use as the heater means 50 and having conventional male 2½ NPT inlet and outlet passage connections is available as Model CBLNA47Gnn from Watlow, Inc. of St. Louis, Mo., wherein nn is a voltage code (10 is 240 volt/1 phase; 3 is 240 volt/3 phase).

As more particularly shown in FIG. 1, the nozzle means 30 includes a material inlet **30*a* and a material outlet 30*b* for receiving and passing the particles 14 from the material conduit 26 to a nozzle outlet 30*c*, a gas inlet 30*d* for receiving high pressure gas from the blast conduit 48, a venturi member 30*e* together with the high pressure gas accelerating the particles between the material outlet 30*b* and the nozzle outlet 30*c***.

As further shown in FIG. 1, an exemplary configuration of the apparatus 10 includes a comminutor 52 for fracturing a controllable portion of the pelletized media 14, thereby delivering a greater number of smaller particles to the nozzle means than are transmitted by the feeder means, as further described below, the comminutor 52 is connected by a short coupling 54 to the material inlet **30*a* of the nozzle means 30. The present invention provides the advantages of cold particulate delivery in the presence of heated gas for reduced cooling of the workpiece, but without the harmful effects of excessive heating of the media 14, because the heated gas comes into contact with the media 14 only during the final acceleration of the media 14 from the nozzle means 30**.

With further reference to FIGS. 2 and 3, preliminary testing of the apparatus 10 as shown in FIG. 1 but without the comminutor 52, has been conducted, the nozzle means 30 being directed onto a test workpiece 60 having a temperature sensor 62 centrally located thereon. The workpiece 60 was formed from a sheet of 2219 T87 aluminum alloy having a thickness of 0.080 inch, a length PL of 12 inches and a width PW of 12 inches. The stream 28 was advanced at constant rates of 1, 2, and 3 inches per second lengthwise across a laterally centrally located blasting path 64 opposite the sensor 62, the path 64 having path width BW of approximately 4 inches, the temperature drop $\Delta T$ being measured at the sensor 62 by suitable means (not shown), the results being presented in FIG. 9 by sets of plotted curves 64.

The testing was done at a constant pressure of approximately 240 psi at the main passage 32, with a flow rate of the dry ice media 14 between approximately 475 and approximately 500 pounds per hour. As shown in FIG. 9, a first set of the curves **64*x*, designated 64*ax* and 64*bx*, represents the cooling of the workpiece 60 with the heater means 50 inoperative, a second set of the curves 64*o*, designated 64*ao* and 64*bo*, representing the cooling with the heater means 50 operating at 9 kW input and raising the temperature of the gas from the blast passage 48 by approximately 80° F., from about 85° F. to about 165° F. Of the curves 64*x* and 64*o*, a pair 64*ax* and 64*ao* represent a maximum depression in the temperature of the workpiece 60 at the sensor 62, data points being indicated by "x" for the curve 64*ax* and by "○" for the curve 64*ao*. The remaining pair of the curves, designated 64*bx* and 64*bo*, represent the time history of the measured temperature from a start of the blasting at one edge of the workpiece 60 until after an end or stop of the blasting at the opposite edge of the workpiece 60**.

As shown in FIG. 9 by the curves **64*ax* and 64*ao*, operation of the apparatus 10 with the heating means 50 activated significantly limits the maximum temperature drop $\Delta T$ of the workpiece 60. In particular, the maximum temperature drop $\Delta T$ was nearly 75° F. with the heater means 50 inactive at the 1 inch per second blasting rate, but $\Delta T$ was limited to approximately 35° F. with the heater means 50 activated as described above. Further, the maximum temperature drop $\Delta T$ was cut to approximately half or less at each of the rates 1, 2, and 3 inches per second when the heater means 50 was activated. In these tests, no significant degradation of the effectiveness of the blasting for cleaning the workpiece 60** was observed.

According to the test results, activation of the heater means 50 was effective for preventing or severely limiting the collection of moisture on the workpiece, in that the workpiece was kept well above the dew-point temperature (which is reached at $\Delta T \geqq$ about 32° F.) at the blast rates of 3 and 2 inches per second. Even at the 1 inch per second rate, the temperature only momentarily approached or reached the dew-point, as compared with a period of several seconds during which the sensor 62 recorded temperatures significantly below the dew point when the heater means 50 was inactive.

With further reference to FIGS. 4–6, an exemplary and preferred configuration of the comminutor 52 includes a cylindrically tubular housing 70 having a plurality of blade members 72 transversely supported therein in an axially spaced, angularly staggered relation, each of the blade members 72 protruding opposite sides of the housing 70, opposite end portions thereof being clinched over as indicated at 74 for anchoring the blade members 72 in place. As shown in FIG. 4, the blade members 72 are axially spaced by a longitudinal spacing S and a corresponding center distance C. As also shown in FIG. 5, the blade members 72 are uniformly angularly spaced by an angle $\phi$ about a centrally located comminutor axis 76 of the housing 70. In the exemplary configuration of FIGS. 4–6, adjacent ones of the blade members 72 are angularly offset by the angle $\phi$.

As best shown in FIG. 6, a preferred cross-sectional configuration of the blade members 72 is longitudinally elongated to a length L, having a reduced lateral thickness T between front and rear wedge-shaped extremities 78, designated front extremity **78*a* and rear extremity 78*b*. The front extremity 78*a* is configured for cleanly slicing or fracturing incoming pellets of the media 14, each of the extremities 78 also being configured for minimally affecting the flow of gas through the housing 70. As further shown in FIG. 6, the front extremity 78*a* forms a leading apex angle A that is preferably less than about 30°. A particularly advantageous configuration of the front extremity 78*a*** is provided by conventional stainless steel razor blade inserts, the angle A being approximately 10°.

The conventional razor blade technology can be utilized by shearing or breaking long hardened and sharpened strips of the stainless steel to an appropriate length for protruding the housing 70. Rather than by bending the end extremities 74 as shown in FIGS. 4–6, the blade members 72 can be retained by a suitable epoxy, or by a ring member that is slipped over the housing 70.

The number of the blade members 72 and the angle $\phi$ by which the blade members 72 are uniformly spaced about the comminutor axis 76 is selected for concentrating the particle size of the media 14 that is delivered to the nozzle means 30 in a desired range. More importantly, a desired mix of the particle sizes is obtained by first forming the pelletized media relatively large, such as having a diameter of approximately 0.125 inch and a length of approximately 0.31 inch. When it is desired to have all of the particles be smaller, the housing 70 is provided with a full complement of the blade members 72. When a concentration of the small particles is to be mixed with a proportion of the larger undivided pellets, some of the blade members are removed from the housing 70 (or another of the comminutors 52 so configured is substituted), two or more of the blade members 72 being adjacently spaced by the angle $\phi$. Thus a greater number of the full complement of the blade members produces a mix having a smaller proportion of the full-sized pellets, and vice-versa. Moreover, the size of the smaller particles is controlled by selecting the angle $\phi$. One way to do this is by omitting alternate ones of the blade members 72, thereby doubling the angle $\phi$. Another way is by substituting for the housing 70 another that is made for the desired angle $\phi$.

As discussed above, it is believed that the net blasting effectivity at a given flow rate of the media 14 is enhanced by having a greater number of smaller particles. Tests have been conducted for confirming the advantages of utilizing reduced particle size, using a Laser Grey Probe System from Particle Measurement Systems of Boulder, Col. The tests were conducted for the purpose of correlating the particle size with the velocity of the delivered particles, in an effort to relate the total momentum of the delivered particles with the particle size at constant delivery rate and blast pressure.

Silhouette images of the particles as they crossed the instrument view area were measured: the width to represent particle size and length to represent particle velocity. Approximately 70 images of $CO_2$ pellets were measured. From these measurements, a pellet size was developed by multiplying the image length by the width, the product being taken to the 1.5 power for representing a 3-dimensional volume. The length measurement was also multiplied by 300 (a nominal maximum velocity setting of the instrument), this product being divided by the width. A calculation was then made for predicting the pellet velocity for various pellet sizes, at a drive pressure of 73 psia for comparison with the test data, the calculated data being presented below in Table 1. Table 1 includes calculated values of kinetic energy per particle size, the number of particles in a given total volume of the media 14, and the cumulative energy for that number of particles of each size. As shown in Table 1, the cumulative kinetic energy (which is believed to be a measure of blasting effectiveness for some coatings or contaminants) increases as the particle size decreases, according to the calculations. The velocity data from the measurements was averaged, within size increments, and is tabulated below in Table 2, a scale factor of 1.28 being used for providing an equivalent pellet size, the data being plotted in FIG. 7.

TABLE 1

| Calculated Cumulative Nozzle Impact Energy | | | | | |
|---|---|---|---|---|---|
| Length (in.) | Velocity (ft./sec.) | Mass ($\times 10^{-6}$) | Kin. En. Per Particle | No. of Particles | Cumulative Kin. En. |
| 0.025 | 505.4 | 0.517 | .066 | 4009 | 264.59 |
| 0.050 | 405.4 | 1.033 | .085 | 2005 | 170.43 |
| 0.075 | 355.2 | 1.550 | .098 | 1336 | 130.93 |
| 0.100 | 319.3 | 2.067 | .105 | 1002 | 105.21 |
| 0.125 | 296.0 | 2.583 | .113 | 802 | 90.63 |
| 0.150 | 275.5 | 3.100 | .118 | 668 | 78.82 |
| 0.175 | 260.2 | 3.617 | .122 | 573 | 69.91 |
| 0.200 | 248.2 | 4.133 | .127 | 501 | 63.63 |
| 0.225 | 237.1 | 4.650 | .131 | 445 | 58.30 |

TABLE 2

| Reduced Data | | |
|---|---|---|
| Size (L × W) 1.5 | Equivalent Length | Average Velocity |
| .000–.010 | .006 | 476 |
| .010–.020 | .019 | 459 |

TABLE 2-continued

| Size (L × W) 1.5 | Reduced Data Equivalent Length | Average Velocity |
|---|---|---|
| .020-.030 | .032 | 453 |
| .030-.040 | .045 | 417 |
| .040-.050 | .058 | 382 |
| .050-.060 | .070 | 365 |
| .060-.070 | .083 | 346 |
| .070-.080 | .096 | 268 |
| .080-.090 | — | — |
| .090-.100 | .122 | 355 |
| .100-.110 | .134 | 280 |
| .110-.120 | — | — |
| .120-.130 | .160 | 262 |

As shown in FIG. 7, there is good correlation between the calculated values and the reduced data for particle sizes between 0.03 and 0.15 inches. An experimental prototype of the comminutor 52 has been built in the configuration of FIGS. 4 and 5, but substituting 0.045 inch diameter stainless steel wire for the blade members 72, the spacing C being approximately 0.125 inch, the angle $\phi$ being approximately 22.5°. In preliminary testing of the apparatus 10 having the experimental comminutor 52, significantly improved blasting effectiveness was observed with certain coatings of the workpiece, particularly enamels.

Thus the comminutor 52 of the experimental configuration provides improved blasting effectiveness in the system 10. Greater improvement is expected with use of the blade members 72 configured as shown and described above in FIG. 6.

With further reference to FIGS. 8 and 9, alternative configurations of the comminutor 52 have at least some of the blade members 72 laterally displaced from the comminutor axis 76. As shown in FIG. 8, the blade members 72 form a five-sided star-shaped pattern when viewed from one end of the housing 70. Alternatively, and as shown in FIG. 9, the blade members 72 form an eight-sided star-shaped pattern.

The comminutor 52 can be coupled to the nozzle means 30 by a conventional quick-release coupling. Alternatively, the comminutor 52 can be built into the nozzle means 30 as shown in FIG. 10.

Although the present invention has been described in considerable detail with reference to certain preferred versions thereof, other versions are possible. For example, other heater power ratings and power settings can be used. Therefore, the spirit and scope of the appended claims should not necessarily be limited to the description of the preferred versions contained herein.

What is claimed is:

1. Apparatus for treatment of a workpiece by blasting same with sublimable particles (14), comprising:

(a) a source (12) of the particles, the particles having an incoming first average volume per particle;

(b) a nozzle unit (30) spaced from the source and having a gas inlet (30*d*) for receiving a high pressure gas, and a particulate inlet (30*a*) for receiving the particles, the particulate inlet being in fluid communication with a material outlet (30*b*), a nozzle outlet (30*c*) in fluid communication with the gas inlet being located downstream of the material outlet;

(c) transport means (22) for transporting the particles from the source to the particulate inlet of the nozzle unit;

(d) divider means (52) proximate the particulate inlet of the nozzle unit for splitting at least a portion of the particles, whereby the average volume of the particles is reduced from the incoming first average volume per particle to a second average volume per particle, the second average volume being less than approximately the first average volume; and (e) accelerator means (30*e*) in the nozzle unit for accelerating the particles to high velocity in response to the high pressure gas.

2. The apparatus of claim 1, wherein the divider means comprises a tubular passage member (70) through which the particles travel between the source and the material outlet, and a plurality of cutter members (72) extending laterally within the passage member and positioned for contacting and splitting at least a portion of the passing particles.

3. The apparatus of claim 2, wherein the cutter members are formed by high-strength wire members, the wire members being supported under tension within the passage.

4. The apparatus of claim 2, wherein the cutter members are formed as blade members, having a wedge-shaped cross-sectional configuration, respective front extremity apexes (78*a*) of the blade members facing upstream in the passage.

5. The apparatus of claim 2, wherein the tubular member is formed for locating lateral end extremities (74) of the cutter members at a uniform angular spacing ($\phi$) about a central comminutor axis (76) of the passage member.

6. The apparatus of claim 5, wherein a partial complement of the cutter members is included in the divider means for forming a mix of a first group of larger particles and a second group of smaller particles.

7. The apparatus of claim 2, wherein the divider means further comprises coupling means (54) for connecting the passage member to the particulate inlet of the nozzle unit.

8. The apparatus of claim 2, wherein the divider means is supported within the nozzle unit.

9. Apparatus for treatment of a workpiece by blasting same with sublimable particles (14), comprising:

(a) a source (12) of the particles;

(b) a nozzle unit (30) spaced from the source and having a gas inlet (30*d*) for receiving a high pressure gas, and a particulate inlet (30*a*) for receiving the particles, the particulate inlet being in fluid communication with a material outlet (30*b*), a nozzle outlet (30*c*) in fluid communication with the gas inlet being located downstream of the material outlet;

(c) transport means (22) for transporting the particles from the source to the particulate inlet of the nozzle unit;

(d) accelerator means (30*e*) in the nozzle unit for accelerating the particles to high velocity in response to the high pressure gas, the particles having a particle temperature at the material outlet; and (e) heater means (50) for heating the high pressure gas, whereby the particles are delivered from the nozzle in a stream (28) of outlet gas, the outlet gas having a gas temperature at the nozzle outlet, the gas temperature being at least 20° C. above the particle temperature for limiting heat removal from the workpiece.

10. The apparatus of claim 9, further comprising divider means (52) proximate the nozzle unit for splitting at least some of the particles, whereby an average volume of the particles is reduced for conveniently obtaining a desired particle size.

* * * * *